US005341760A

United States Patent [19]

Summers

[11] Patent Number: 5,341,760

[45] Date of Patent: Aug. 30, 1994

[54] TARPAULIN DRAINAGE APPARATUS

[76] Inventor: James A. Summers, 27717 Avenue Scott, Valencia, Calif. 91355

[21] Appl. No.: 126,873

[22] Filed: Sep. 27, 1993

[51] Int. Cl.[5] ..... B63B 17/00

[52] U.S. Cl. ..... 114/361; 114/222; 135/89

[58] Field of Search ..... 114/361, 222; 135/88, 135/89, 90, 91, 120; 296/100, 101; 150/166

[56] References Cited

U.S. PATENT DOCUMENTS 3,475,772 11/1969 Lokken ..... 114/361

5,143,014 9/1992 Gabison ..... 114/361

*Primary Examiner*—Jesus D. Sotelo

*Attorney, Agent, or Firm*—Jack C. Munro

[57] ABSTRACT

A drainage apparatus for draining water from the top surface of a tarp which has been used to cover an exterior object. The drainage apparatus includes a funnel and a washer which is to abut against the back surface of the funnel with the funnel having a tubular section which is conducted through a hole in the tarp. A clamp nut is tightened against the back surface of the washer. A drain hose is connected to the tubular lower end with the water to be conducted through the funnel into the drain hose and then to a disposing location.

2 Claims, 1 Drawing Sheet

TARPAULIN DRAINAGE APPARATUS

BACKGROUND OF THE INVENTION

1) Field of the Invention

A tarpaulin drainage apparatus for a sheet material flexible cover, defined as a tarpaulin, for an exterior structure such as a boat or other type of vehicle which permits the water to be automatically drained from any low area of the cover preventing collapsing, sagging, and premature destruction of the cover.

2) Description of the Prior Art

A cover for an exterior structure to protect the exterior structure from the elements is commonly referred to as a tarpaulin (hereinafter referred to as a tarp). Tarps are commonly used in conjunction with boats. A common problem associated with tarps on boats is that water will accumulate on the top surface of the tarp in a low area. The weight of the water causes the tarp to sag and stretch forming a depression or pocket. If the water is not removed within a short period of time, the water will eventually drip through the tarp into the boat which can cause certain parts of the boat to mildew or rot. The tarp will inherently sag and stretch under the weight of the water which will eventually result in the tarp tearing requiring premature replacement. Most tarps that are of a good quality are of a significant expense and premature replacement is certainly not desired by anyone.

Additionally, the weight of the accumulated water within the tarp makes it difficult to remove the tarp when it is desired to use the boat. Also at times, the excessive weight of the accumulated water on the tarp can cause a securing means located at the peripheral edge of the tarp to give way resulting in collapse of the tarp and entry of the accumulated water into the interior of the boat.

In the past, there have been numerous attempts to prevent the accumulation of water on tarps. One such attempt is the placement of a vertical pole between the deck of the boat and the center of the tarp, underneath the tarp, so as to form a tent-like configuration so that the water will tend not to accumulate in any low area. While this method has had some degree of success, generally there will always be some low spots where water will tend to accumulate. Even a small amount of water accumulating in a small area will result in premature destruction of the tarp. Additionally, the force exerted by the pole on the tarp causes damaging of the tarp.

It has also been known to utilize a drain apparatus for the low area of a tarp with this drain attachment being mounted in conjunction with the tarp. The water that accumulate in the low areas is to be conducted through the drain attachment to a drain hose with the outlet of the drain hose being located at a desirable disposing location. The disadvantage of these prior drain apparatuses is that such have been somewhat complex in construction and frequently required custom installation or modification of the boat itself. Also during installing of the drainage apparatus, the drainage apparatus itself does not include any depression to facilitate the creation of a lowest area toward which the water is encouraged to accumulate. Still further during installation of the device there has been a tendency for the tarp to be twisted and possibly tear.

The primary objective of the present invention is to provide a drainage apparatus for a tarp to drain water from a low area within the top surface of the tarp preventing accumulation of water thereon.

Another objective of the present invention is to provide a drainage apparatus which is adapted for easy and quick attachment to an existing tarp.

Another objective of the present invention is to construct the drainage apparatus of few parts that can be quickly installed on the tarp even by individuals of minimum skill.

Another objective of the present invention is to construct a tarp drainage apparatus which does not damage the tarp when installed.

DETAILED DESCRIPTION OF THE SHOWN EMBODIMENT

Figure 1:
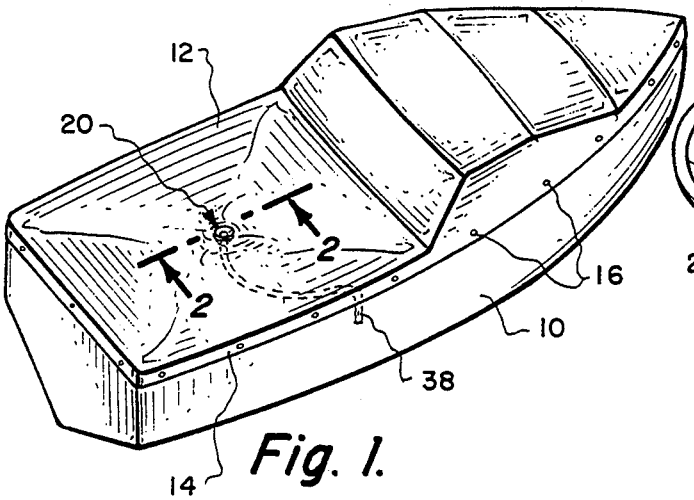
FIG. 1 is an isometric view of a tarp stretched across the top of a boat showing the drainage apparatus of the present invention being installed in conjunction with the tarp.
Figure 2:
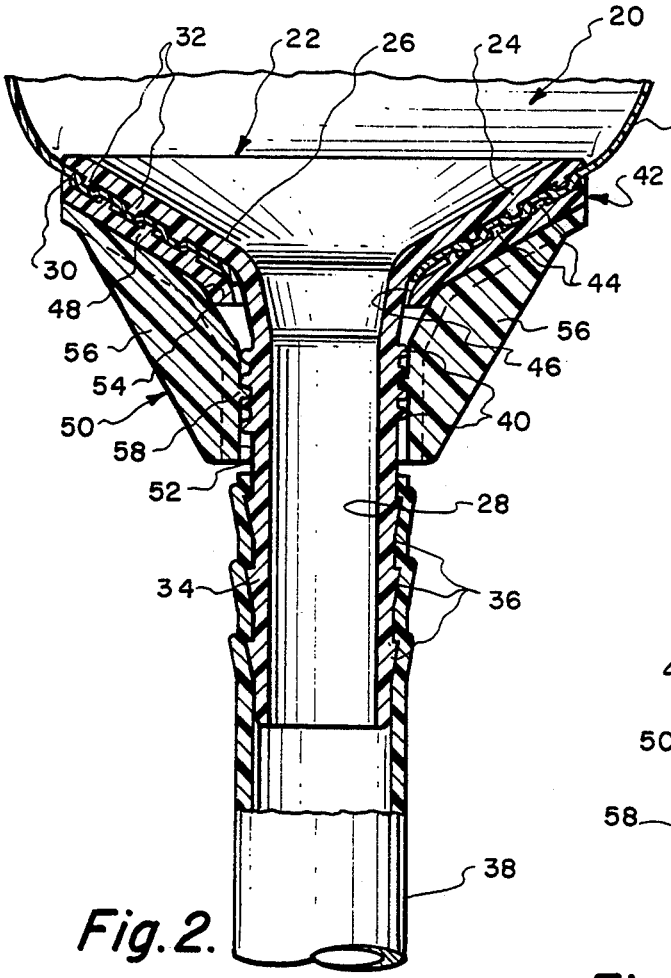
FIG. 2 is a longitudinal cross-sectional view through the drainage apparatus of the present invention taken along line 2—2 of FIG. 1.
Figure 3:
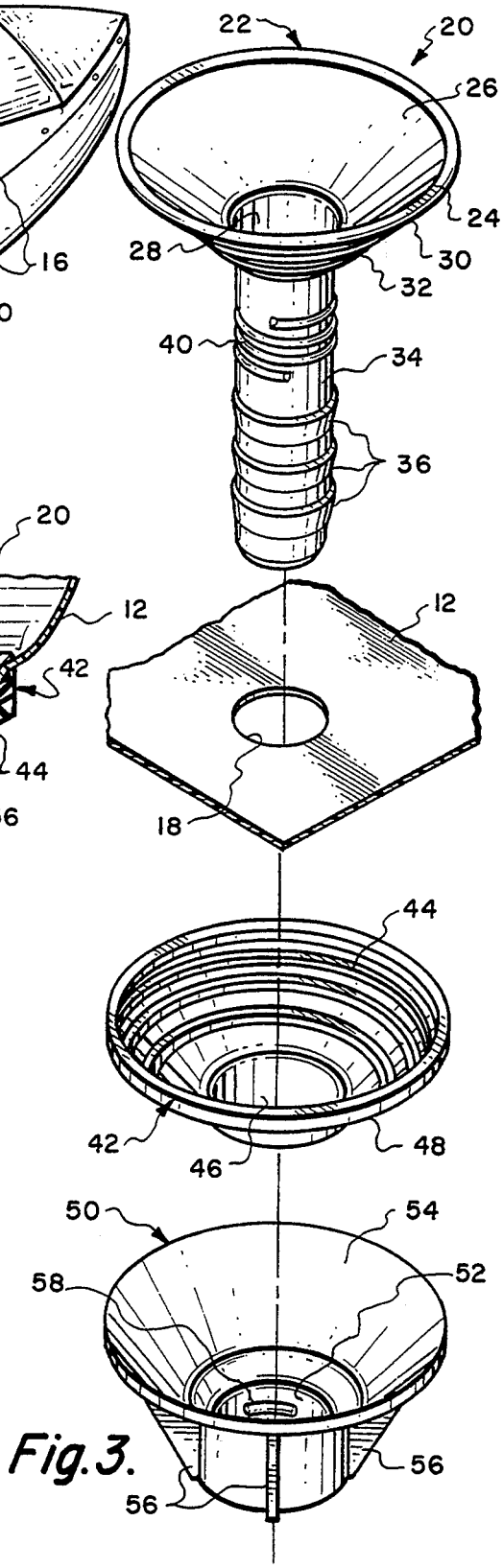
FIG. 3 is an exploded isometric view of the drainage apparatus of the present invention.

Referring particularly to the drawing there is shown a boat 10 which is covered by a tarp 12. The tarp 12 has a periphery 14 which is secured by a conventional series of fasteners 16 about the deck of the boat 10. At the center of the lowest spot of the tarp 12 that would normally collect water there is formed a hole 18. Connecting with the hole 18 is the drainage apparatus 20 of this invention.

The drainage apparatus 20 includes a funnel 22 which has an annular flared upper end 24 which has an annular, cup shaped, smooth tapered, interior surface 26. The surface 26 connects with a center through opening 28. The upper end 24 has a back annular surface 30. This back annular surface 30 includes a series of annular ridges 32.

The center through opening 28 extends through the tubular lower end 34 the funnel 22. The exterior surface of the tubular lower end 34 includes a series of annular ridges 36 with these ridges functioning provide a secure connection with a drain hose 38. Generally the drain hose 38 will be constructed of a rubber or plastic material. One end of the drain hose 38 is to be forcibly inserted in a snug fitting manner over the tubular lower end 34 with the ridges 36 providing a secure connection, preventing leakage of any liquid therebetween. The free outer end of the drain hose 38 is to be placed at some appropriate disposing location which must be lower than the drainage apparatus 20 in order to provide for adequate drainage of the water therefrom. In FIG. 1, the drain hose 38 is shown connecting with the periphery 14 of the tarp 12 and the deck area of the boat 10. However this type of a connection would only occur if the end of the drain hose 38 is at a lower position than the drainage apparatus 20. This end of the drain hose 38 could connect with any appropriate drainage opening formed within the hull of the boat 10 or could be located within a pumping cavity of the interior of the hull of the boat 10.

Also formed on the exterior surface of the tubular lower end 34 are a series of exterior screw threads 40.

The function of these screw threads will be explained further on in the specification.

A clamping washer 42 has a cup shaped, interior which includes a series of spaced-apart annular ridges 44. The washer 42 has a center opening 46. The washer 42 also has a smoothly contoured back surface 48. The tubular lower end 34 is to be conducted through the hole 18 from the top side of the tarp 12. The center hole 46 of the washer 42 is then connected with the tubular lower end 34 which passes through the center opening 46 until the ridges 44 come into abutting contact with the lower surface of the tarp 12 located about the hole 18. At the same time the ridges 32 abuttingly contact the top surface of the tarp 12 about the hole 18.

A clamp nut 50 is then utilized which has a center through hole 52. The clamp nut 50 has a tapered, smoothly contoured, interior clamping surface 54. The exterior surface of the clamp nut 50 includes a series of strengthening ribs 56. The through hole 52 includes a series of interior screw threads 58. These screw threads 58 are to connect with the screw threads 40 and by manually applying a turning torque to the clamp nut 50 utilizing the ribs 56, the clamp nut 50 can be tightly pressed against the washer 42 with surface 54 sliding on surface 48 and the washer 42 remaining in position. The washer 42 remains in this position because of the resistance obtained between the ridges 44 and 32 in conjunction with the tarp 12. This prevents the tarp 12 from "bunching up", twisting, and/or tearing during the time that the clamp nut 50 is tightly installed in position. Once the clamp nut 50 is tightly installed in position and the drain hose 38 is appropriately located to a draining location, no further installing procedure is required and any water, rain or otherwise that is collected on the top surface of the tarp 12 will automatically drain through the center through opening 28 of the funnel 22 and into the drain hose 38.

What is claimed is:

1. A tarp drainage apparatus for draining liquid from a low area within the top surface of a tarp which has been used to cover an exterior object, said tarp drainage apparatus comprising:

a funnel having a flared upper end and a tubular lower end, said flared upper end being cup shaped, said funnel having a center through opening adapted to pass liquid therethrough, said flared upper end having a back annular surface, said tubular lower end adapted to be conducted through a hole in a tarp with said back annular surface resting on the tarp, said tubular lower end having a series of exterior screw threads;

a washer having a center opening, said washer having a cup shaped surface which matingly matches with said cup shaped surface of said flared upper end, said cup shaped surface to abut against said back annular surface with the tarp adapted to be located therebetween, said tubular lower end located within said center opening, said washer having a smoothly contoured back surface;

a clamping nut having a through hole, said clamping nut having a smoothly contoured clamping surface, said through hole including a series of internal screw threads, said internal screw threads to engage with said exterior screw threads with said clamping surface abutting against said smoothly contoured back surface, whereby as said clamping nut is tightened said smoothly contoured clamping surface slides on said smoothly contoured back surface tightly clamping the tarp between said funnel and said washer;

said back annular surface having a plurality of first protuberances, said cup shaped surface having a plurality of second protuberances, said first and second protuberances cooperate together to tightly clamp therebetween the tarp and prevent rotational movement of said washer relative to said funnel;

a drain hose, said drain hose being secured to said tubular lower end, whereby the draining liquid is to be conducted from said center through opening into said drain hose and to a desired disposing location located spaced from said tarp drainage apparatus; and said clamping nut having an exterior surface which includes a series of spaced apart ribs, said ribs facilitating manual installation of said drainage apparatus by a human by being manually contactable to apply a turning torque during tightening of said clamping nut.

2. A tarp drainage apparatus for draining liquid from a low area within the top surface of a tarp which has been used to cover an exterior object, said tarp drainage apparatus comprising:

a funnel having a flared upper end and a tubular lower end, said flared upper end being cup shaped, said funnel having a center through opening adapted to pass liquid therethrough, said flared upper end having a back annular surface, said tubular lower end adapted to be conducted through a hole in a tarp with said back annular surface resting on the tarp, said tubular lower end having a series of exterior screw threads;

a washer having a center opening, said washer having a cup shaped surface which matingly matches with said cup shaped surface of said flared upper end, said cup shaped surface to abut against said back annular surface with the tarp adapted to be located therebetween, said tubular lower end located within said center opening, said washer having a smoothly contoured back surface;

a clamping nut having a through hole, said clamping nut having a smoothly contoured clamping surface, said through hole including a series of internal screw threads, said internal screw threads to engage with said exterior screw threads with said clamping surface abutting against said smoothly contoured back surface, whereby as said clamping nut is tightened said smoothly contoured clamping surface slides on said smoothly contoured back surface tightly clamping the tarp between said funnel and said washer; and said clamping nut having an exterior surface which includes a series of spaced apart ribs, said ribs facilitating manual installation of said drainage apparatus by a human being manually contactable to apply a turning torque during tightening of said clamping nut.

* * * * *